US009683273B2

(12) United States Patent
Matway et al.

(10) Patent No.: US 9,683,273 B2
(45) Date of Patent: Jun. 20, 2017

(54) ALLOY REFINING METHODS

(71) Applicant: ATI PROPERTIES LLC, Albany, OR (US)

(72) Inventors: Roy J. Matway, Pittsburgh, PA (US); Kenneth G. Malencia, Butler, PA (US); Jay E. Rupert, Leechburg, PA (US)

(73) Assignee: ATI PROPERTIES LLC, Albany, OR (US)

( * ) Notice: Subject to any disclaimer, the term of this patent is extended or adjusted under 35 U.S.C. 154(b) by 76 days.

(21) Appl. No.: 14/683,176

(22) Filed: Apr. 10, 2015

(65) Prior Publication Data

US 2015/0211082 A1 Jul. 30, 2015

Related U.S. Application Data

(63) Continuation of application No. 13/795,479, filed on Mar. 12, 2013, now Pat. No. 9,045,805.

(51) Int. Cl.

| | |
|---|---|
| ***C21C 7/00*** | (2006.01) |
| ***C22B 9/05*** | (2006.01) |
| ***C21C 5/34*** | (2006.01) |
| ***C21C 5/48*** | (2006.01) |
| ***C21C 7/068*** | (2006.01) |

(Continued)

(52) U.S. Cl.

CPC ..... *C21C 7/068* (2013.01); *C21B 7/16* (2013.01); *C21C 5/34* (2013.01); *C21C 5/48* (2013.01); *C21C 7/072* (2013.01); *C22B 9/05* (2013.01); *C22B 23/06* (2013.01); *C22C 38/02* (2013.01)

(58) Field of Classification Search

CPC .. C21C 5/34; C21C 5/48; C21C 7/068; C21C 7/072; C22B 9/05

See application file for complete search history.

(56) References Cited

U.S. PATENT DOCUMENTS

| | | | |
|---|---|---|---|
| 2,855,293 | A | 10/1958 | Savard et al. |
| 3,643,451 | A | 2/1972 | Foucar |

(Continued)

FOREIGN PATENT DOCUMENTS

| | | | |
|---|---|---|---|
| CA | 1206854 | | 7/1986 |
| CN | 102628094 | A | 8/2012 |

(Continued)

OTHER PUBLICATIONS

Anghelina, Dorel, Decarburization of Low Carbon Steel Melts with CO2—O2 Under Vacuum, Mar. 10, 2002.

(Continued)

*Primary Examiner* — George Wyszomierski
*Assistant Examiner* — Tima M McGuthry Banks
(74) *Attorney, Agent, or Firm* — K&L Gates LLP

(57) ABSTRACT

A method of decarburizing a molten alloy may generally comprise injecting a first gas comprising at least one of argon, carbon dioxide, and oxygen through a first fluid-conducting portion of a tuyere into the molten alloy below the surface of the molten alloy, and injecting a second gas comprising at least one of argon and carbon dioxide through a second fluid-conducting portion of the tuyere into the molten alloy below the surface of the molten alloy. The tuyere may comprise an inner portion concentrically aligned within an outer portion to define an annulus therebetween. The first gas may be injected through the inner portion, and the second gas may be injected through the annulus.

28 Claims, 3 Drawing Sheets

(51) Int. Cl.

| | |
|---|---|
| ***C21B 7/16*** | (2006.01) |
| ***C21C 7/072*** | (2006.01) |
| ***C22B 23/06*** | (2006.01) |
| ***C22C 38/02*** | (2006.01) |

(56) References Cited

U.S. PATENT DOCUMENTS

| | | | |
|---|---|---|---|
| 3,649,246 | A | 3/1972 | Fulton |
| 3,769,000 | A | 10/1973 | Glassman |
| 3,861,888 | A | 1/1975 | Heise et al. |
| 3,895,784 | A | 7/1975 | Kolb et al. |
| 3,997,335 | A | 12/1976 | Kolb et al. |
| RE29,584 | E | 3/1978 | Heise et al. |
| 4,208,206 | A | 6/1980 | Death |
| 4,280,838 | A | 7/1981 | Marukawa et al. |
| 4,330,108 | A | 5/1982 | Nakanishi et al. |
| 4,336,064 | A | 6/1982 | Savard et al. |
| 4,424,955 | A | 1/1984 | Wells |
| 4,436,287 | A | 3/1984 | Sakuraya et al. |
| 4,450,005 | A | 5/1984 | Nakao et al. |
| 4,450,017 | A | 5/1984 | Berger et al. |
| 4,451,289 | A | 5/1984 | Van Hecke et al. |
| 4,599,107 | A | 7/1986 | Masterson |
| 5,190,577 | A | 3/1993 | Bermel et al. |
| 5,435,833 | A | 7/1995 | Bustos |
| 6,071,466 | A | 6/2000 | Cates et al. |
| 9,045,805 | B2 | 6/2015 | Matway et al. |

FOREIGN PATENT DOCUMENTS

| | | | |
|---|---|---|---|
| EP | 0392239 | | 10/1990 |
| GB | 2071831 | A | 9/1981 |
| JP | 54-60212 | A | 5/1979 |
| JP | 5-967310 | A | 4/1984 |
| JP | 6-330142 | A | 11/1994 |
| JP | 6-330143 | A | 11/1994 |
| JP | 7-233408 | A | 9/1995 |
| JP | 7-331321 | A | 12/1995 |
| JP | 2-000045019 | A | 2/2000 |

OTHER PUBLICATIONS

ASTM, Standard Specification for Flat-Rolled, Grain-Oriented, Silicon-Iron, Electrical Steel, Fully Processed Types, Dec. 2012, 6 pages.
King, P. C., Ferritic Nitrocarburising of Tool Steels, Aug. 12, 2004, 14 pages.
Koenigsmann, Von W., Scaling and Decarburization of Iron-Carbon Alloys in Carbon Dioxide Containing Gases, vol. 31, Apr. 1980, pp. 271-280.
Nomura, Hiroyuki, Kinetics of Decarburization of Liquid Iron in Ar—CO—CO2 Atmospheres, May 7, 1973, 11 pages.
Selines, Dr. Ronald J., Selection of Stirring and Shrouding Gases for Steelmaking Applications, 1988, 20 pages.
Ueda, Tsuguharu, Production of Carbon and Low-Alloy Steel With STB-Process, vol. 64, Mar. 29, 1981, 9 pages.
Oxidation Rate Controlling Factors, Electric Furnace Conference Proceedings, 1989, 1 page.
AISE Steel Foundation, The Bottom-Blown Oxygen Steelmaking or OBM (Q-BOP) Process, Pittsburgh, PA, 1998, pp. 504-513.
Amano, Kazuo, Kinetics of the Decarburization of Molten Fe—Cr Alloy with CO2—CO—Ar Mixture or Chromic Oxide, Feb. 22, 1978, pp. 53-59.
Atanasov, S., Study of the Effect of Nitrogen on the Kinetics of Solid Phase Decarburization of Cast Iron, Sep. 1978, 5 pages.
Barnett, J. H., The Role of Scale in the Decarburization of Steel by Atmospheres of Air and Carbon Monoxide/Carbon Dioxide Mixtures at 700° and 1100° C., Jun. 1970, 9 pages.
Choulet, Richard J., Stainless Steel Refining, Jun. 5, 1997, 19 pages.
De Castro, J., Mathematical Modeling of Decarburizing Process of Electrical Steels. Jul. 19-22, 2005, 11 pages.
Desilva, R.A.B, Use of CO2 in Decarburizing Steel in the Electric Furnace, Mar. 1972, 1 page.
Draker, Robert L., Control of Surface Carbon During Intercritical and Subcritical Annealing, Jan. 2000, 9 pages.
Goto, Kazuhiro, On the Rate of Decarburization of Liquid Metals with CO—CO2 Gas Mixture. Feb. 1969, 9 pages.
Hamielec, A. E., Interpretation of Kinetic Data for the Decarburization of Iron Droplets, Oct.-Dec. 1968, 6 pages, vol. 7, No. 4.
Hornby Anderson, Sara, Cost and Quality Effectiveness of Carbon Dioxide in Steelmills, Oct. 29-Nov. 1, 1989, vol. 47.
Hornby Anderson, Sara, Use of CO2 in the AOD, Dec. 11-14, 1990, vol. 48, 10 pages.
Koch, K., Reactions During Top Blowing of Carbon Dioxide on Fe—C—Cr Melts Under Vacuum, Apr. 1983, vol. 54, No. 4.
Loscher, W., Decarburization of Slag-Free Carbon-Rich Iron Melts With the Aid of Blown-On Carbon Dioxide, Dec. 24, 1970, vol. 90, No. 26, 3 pages.
Mannion, F. J., Decarburization Kinetics of Liquid Carbon-Saturated Iron Alloys by Carbon Dioxide and Water Vapor, 1991, vol. 51, No. 8, 1 page.
LV, Ming, Research on Top and Bottom Mixed Blowing CO2 in Converter Steelmaking Process, Jun. 24, 2011, vol. 83, No. 1, 5 pages.
Misra, Siddhartha, Hydrogen and Nitrogen Control in Steelmaking at U.S. Steel, Nov. 2009, pp. 43-52.
Nagasaka, Tetsuya, Reaction Kinetics of CO2—H2O Gas Mixtures with Liquid Fe—C Alloys, 1994, vol. 34, No. 3, pp. 241-246.
Ono-Nakazato, Hideki, Oxidation Behavior of Silicon and Carbon in Molten Iron-Carbon-Silicon Alloys with Carbon Dioxide, 2001, vol. 41, pp. S61-S65.
Raja, B.V.R., Methods of Refining Stainless Steels, May/Jun. 2006, vol. 30, No. 4, 4 pages.
Saegusa, F., High Temperature Oxidation of AISI 4330 in CO/CO2 Mixtures, Dec. 1975, 22 pages.
Sain, D. R., The Influence of Sulfur on Interfacial Reaction Kinetics in the Decarburization of Liquid Iron by Carbon Dioxide, vol. 9B, Sep. 1978, 5 pages.
Simento, Noel, Kinetics of Decarburisation of Levitating Liquid Iron Drops by Carbon Dioxide, 1998, vol. 69, No. 8, 9 pages.
Soenen, Bart, Modelling Decarburization in Electrical Steels, vol. 76, No. 6, Jun. 2005, 8 pages.
Valette, S., C40E Steel Oxidation Under CO2 Kinetics and Reactional Mechanism, Dec. 28, 2004, 10 pages.
Warner, Noel A., New Reactor Concepts for Direct Coal-Based Continuous Steelmaking, vol. 1, Mar. 2-6, 2003, 21 pages.
Werkst, K. Scaling and Decarburization of Iron-Carbon Alloys in Carbon Dioxide Containing Gases, vol. 31, No. 4, Apr. 1980, 1 page.
Zughbi, Habib Daoud, Decarburization of Fe/C Melts in a Crucible Effects of Bath Sulfur Level and Bath Surface Area, vol. 33, pp. 242-250.
Air Composition, The Engineering ToolBox, http://www.engineeringtoolbox.com/air-composition-d_212.html, Jul. 31, 2014, 1 page.

ALLOY REFINING METHODS

CROSS-REFERENCE TO RELATED APPLICATIONS

The present application claims priority under 35 U.S.C. 120 as a continuation of U.S. patent application Ser. No. 13/795,479, filed on Mar. 12, 2013, now U.S. Pat. No. 9,045,805, the entire disclosure of which is hereby incorporated by reference herein.

BACKGROUND OF THE TECHNOLOGY

Field of Technology

The present disclosure generally relates to methods for refining steels and other alloys.

Description of the Background of the Technology

Argon-oxygen decarburization ("AOD") is a secondary refining process used to decarburize molten alloys. AOD may reduce the carbon content of the molten alloys to a desired level. As applied to ferrous alloys, conventional AOD may generally comprise preparing a melt of a ferrous alloy, transferring the molten alloy to a suitable refining vessel, and injecting a mixture of argon and oxygen gases into the molten alloy through tuyeres. Contacting the molten alloy with the mixture of argon and oxygen gases may generate iron oxide (FeO) and carbon monoxide (CO). The argon may reduce the partial pressure of CO in the gas in contact with the molten alloy and result in preferential oxidation of carbon instead of chromium in molten stainless steel alloys. In this way, the carbon content of the melt may be reduced. The CO and argon injected through the tuyeres may also remove nitrogen from the molten alloy. The efficiency of carbon removal may be influenced by molten alloy composition, original carbon content of the alloy, composition of oxidizing gases, flow rates and temperatures of the injected gases, furnace condition (including size, geometry, and wear condition of the vessel), heat size, and initial and final temperatures of the molten alloy.

AOD and other conventional methods for decarburizing molten alloys may be time-consuming and/or expensive. It would be advantageous to provide improved methods for decarburizing molten alloys.

SUMMARY

One non-limiting aspect according to the present disclosure is directed to a method of decarburizing a molten alloy using at least one tuyere comprising a fluid-conducting outer portion and a fluid-conducting inner portion concentrically aligned within the fluid-conducting outer portion, the arrangement defining a fluid-conducting annulus therebetween. The method comprises injecting a first gas comprising at least one of argon, carbon dioxide, and oxygen through the inner portion of the tuyere into the molten alloy, and injecting a second gas comprising at least one of argon and carbon dioxide through the annulus of the tuyere into the molten alloy.

Another non-limiting aspect according to the present disclosure is directed to a method of treating a molten alloy. The method comprises: injecting oxygen and an inert gas selected from argon, carbon dioxide, and combinations thereof through a first fluid-conducting portion of a tuyere into a molten alloy below the surface of the molten alloy; and injecting at least one of argon and carbon dioxide through a second fluid-conducting portion of the tuyere into the molten alloy below the surface of the molten alloy. In certain embodiments, the first fluid-conducting portion of the tuyere may comprise an inner portion, and the second fluid-conducting portion may comprise a fluid-conducting annulus defined between the inner portion and a concentrically aligned outer portion.

Yet another non-limiting aspect according to the present disclosure is directed to a method of decarburizing a molten alloy. The method comprises: injecting a first gas comprising at least one of argon, carbon dioxide, and oxygen through a first fluid-conducting portion of a tuyere into a molten alloy below the surface of the molten alloy; and injecting at least one of argon and carbon dioxide through a second fluid-conducting portion of the tuyere into the molten alloy below the surface of the molten alloy. In certain embodiments, the first portion comprises an inner portion concentrically aligned within an outer portion to define therebetween the second portion in the form of a fluid-conducting annulus therebetween. In embodiments of the method, the alloy may have a composition suitable for providing a grain oriented electrical steel. In certain embodiments, the method may provide an alloy having a chemical composition conforming to the requirements in ASTM Standard A876, 2012, "Standard Specification for Flat-Rolled, Grain-Oriented, Silicon-Iron, Electrical Steel, Fully Processed Types", which is available from ASTM International, West Conshohocken, Pa. USA (DOI: 10.1520/A0876-12).

A further non-limiting aspect according to the present disclosure is directed to a method of refining a steel composition. The method comprises: providing a melt of an iron-base alloy in a vessel comprising a tuyere, wherein the tuyere comprises a fluid-conducting outer portion and a fluid-conducting inner portion concentrically aligned within the outer portion to define a fluid-conducting annulus therebetween; injecting a first gas comprising at least one of argon, carbon dioxide, and oxygen through the inner portion of the tuyere into the molten alloy below the surface of the molten alloy; and injecting a second gas comprising argon and carbon dioxide through the annulus of the tuyere into the molten alloy below the surface of the molten alloy. In non-limiting embodiments of the method, the steel may comprise, in weight percentages based on total alloy weight: 93 to 99 iron, 0.6 to 3.7 silicon, up to 1.0 nickel, up to 0.5 manganese, up to 0.5 aluminum, up to 0.5 copper, up to 0.4 chromium, up to 0.1 titanium, and incidental impurities.

It is understood that the invention disclosed and described in the present disclosure is not limited to the embodiments described in this Summary or the Abstract.

BRIEF DESCRIPTION OF THE DRAWINGS

The various non-limiting embodiments described herein may be better understood by considering the following description in conjunction with one or more of the accompanying drawings.

Figure 1:
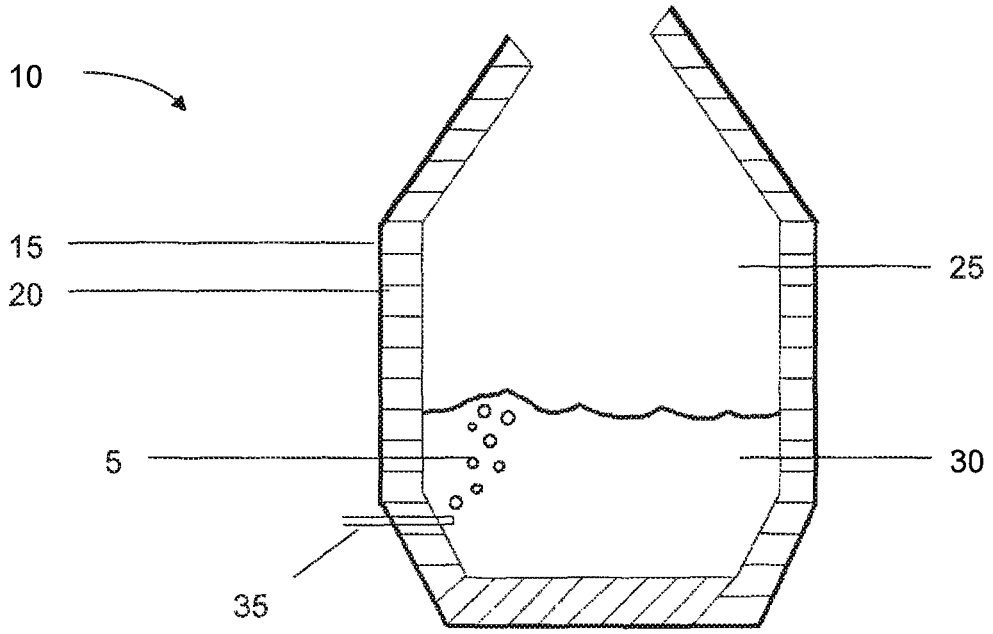
FIG. 1 is a cross-sectional schematic view illustrating aspects of a non-limiting embodiment of a method of decarburizing a molten alloy according to the present disclosure.

The reader will appreciate the foregoing details, as well as others, upon considering the following description of various non-limiting and non-exhaustive embodiments according to the present disclosure.

DESCRIPTION OF CERTAIN NON-LIMITING EMBODIMENTS

The present disclosure describes features, aspects, and advantages of various embodiments of methods of refining alloys. It is understood, however, that this disclosure also embraces numerous alternative embodiments that may be accomplished by combining any of the various features, aspects, and/or advantages of the various embodiments described herein in any combination or sub-combination that one of ordinary skill in the art may find useful. Such combinations or sub-combinations are intended to be included within the scope of this specification. As such, the claims may be amended to recite any features or aspects expressly or inherently described in, or otherwise expressly or inherently supported by, the present disclosure. Further, Applicants reserve the right to amend the claims to affirmatively disclaim any features or aspects that may be present in the prior art. Therefore, any such amendments comply with the requirements of 35 U.S.C. §112, first paragraph, and 35 U.S.C. §132(a). The various embodiments disclosed and described in the present disclosure may comprise, consist of, or consist essentially of the features and aspects as variously described herein.

All numerical quantities stated herein are approximate, unless stated otherwise. Accordingly, the term "about" may be inferred when not expressly stated. The numerical quantities disclosed herein are to be understood as not being strictly limited to the exact numerical values recited. Instead, unless stated otherwise, each numerical value included in the present disclosure is intended to mean both the recited value and a functionally equivalent range surrounding that value. Notwithstanding the approximations of numerical quantities stated herein, the numerical quantities described in specific examples of actual measured values are reported as precisely as possible.

All numerical ranges stated herein include all sub-ranges subsumed therein. For example, a range of "1 to 10" is intended to include all sub-ranges between and including the recited minimum value of 1 and the recited maximum value of 10. Any maximum numerical limitation recited herein is intended to include all lower numerical limitations. Any minimum numerical limitation recited herein is intended to include all higher numerical limitations.

In the following description, certain details are set forth in order to provide a better understanding of various embodiments. However, one skilled in the art will understand that these embodiments may be practiced without these details. In other instances, well-known structures, methods, and/or techniques associated with methods of practicing the various embodiments may not be shown or described in detail to avoid unnecessarily obscuring descriptions of other details of the various embodiments.

As generally used herein, the articles "the", "a", and "an" refer to one or more of what is claimed or described.

As generally used herein, the terms "include", "includes", and "including" are meant to be non-limiting.

As generally used herein, the terms "have", "has", and "having" are meant to be non-limiting.

Referring to FIG. 1, according to various non-limiting embodiments, an apparatus adapted for submerged injection of one or more gases into a molten steel or other molten alloy below the surface of the molten alloy may generally comprise a vessel 10 or converter comprising an outer shell 15 and a refractory material lining 20 defining a cavity 25 to hold the molten alloy 30. The outer shell 15 may comprise, for example, a carbon steel. The refractory material lining 20 may comprise, for example, refractory brick such as, for example, a dolomitic brick and/or a chrome-magnesite brick. At least one tuyere 35 for conveying gaseous fluids may pass through the outer shell 15 and refractory material lining 20, for example, through a bottom or a side of the vessel 10, and pass into the cavity 25 at a level below the surface of the molten alloy 30. A conventional gas supply and metering system (not shown) comprising regulators, supply lines, flow restrictors, valves, flow and pressure measurement devices, and a control unit may be in fluid communication with and supply gas(es) to the at least one tuyere 35. The gas supply and metering system may comprise a source of a first gas in fluid communication with the at least one tuyere 35 and a source of a second gas in fluid communication with the at least one tuyere 35 so that the first and second gases may be introduced into the molten alloy 30 through the tuyere 35.

As further shown in FIG. 1, the at least one tuyere 35 may be submerged when molten alloy 30 is disposed in the cavity 25. The at least one tuyere 35 may comprise a tuyere communicating with the cavity 25 through a bottom surface of the outer shell 15 and refractory material lining 20 (i.e., a bottom submerged tuyere) and/or a tuyere communicating with the cavity 25 through a side surface of the outer shell and the refractory material lining 20 (i.e., a side submerged tuyere). For example, the at least one tuyere may comprise a plurality of side submerged tuyeres. The tuyere 35 may comprise a temperature resistant, thermally conductive material. The tuyere may comprise a conductive metal or metal alloy such as, for example, copper, a copper alloy, or stainless steel, or other suitable material resistant to high temperatures. In various non-limiting embodiments, an inner portion of the tuyere may comprise copper and an outer portion of the tuyere may comprise an austenitic stainless steel.

As shown in FIG. 1, the side submerged tuyere 35 may extend horizontally or diagonally through the outer shell 15 and refractory lining 20 and enter the cavity 25 below the surface of the molten alloy 30. The tuyere 35 may be positioned in the inwardly sloping lower surface of the vessel 10. In certain embodiments, the tuyere may be flush with or below the surface of the refractory material lining 20 of the vessel 10 presented to the cavity 25. A refractory material may surround at least a portion of the tuyere 35 up to the tip thereof entering the cavity 25. In certain embodiments, the tuyere may project beyond the refractory lining of the vessel and a mound, or "knurdle", of refractory material may surround the portion of the tuyere projecting beyond the surface of the refractory material lining. In certain non-limiting embodiments, the tuyere, including the knurdle, may project beyond the refractory lining of the vessel up to 12 inches, such as, for example, from greater than zero to six inches, up to 3 inches, up to 2 inches, up to 1 inch, up to 0.5 inch, up to 0.25 inch, at least 6 inches, at least 4 inches, at least 1 inch, or 1 inch. In certain non-limiting embodiments, the tuyere, including the knurdle, may project beyond the refractory lining without adversely impeding gas flow.

Figure 2:
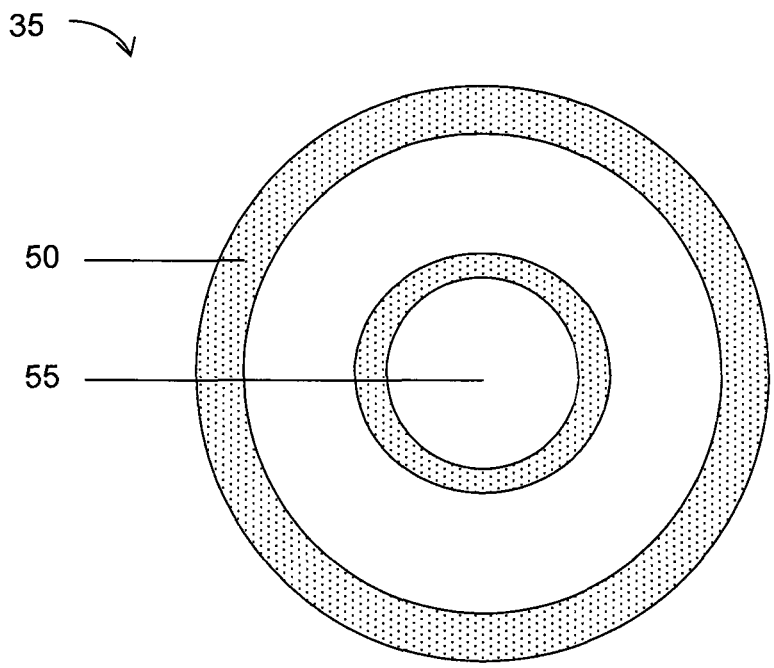
FIG. 2 is a cross-sectional schematic view illustrating aspects of a non-limiting embodiment of a method of decarburizing a molten alloy according to the present disclosure.

FIG. 2 is a cross-section through one non-limiting embodiment of the tuyere 35. As shown in FIG. 2, in various embodiments, the tuyere 35 may comprise a fluid-conducting cylindrical outer portion 50 and a fluid-conducting cylindrical inner portion 55. In certain non-limiting embodiments, the inner portion 55 may be concentrically disposed within the outer portion 50 to define a fluid-conducting annulus therebetween. Tuyeres are commercially available from various sources including, for example, L-TEC Steel Industry Products, Florence, S.C., which offers tuyeres in sizes "A" (3/8 inch diameter×26 inch length), "B" (7/16×26 inch), "C" (1/2×26 inch), "D" (17/32×26 inch), and "E" (5/8×26 inch). In certain non-limiting embodiments, a concentrically disposed cylindrical inner portion of the tuyere may comprise an inner diameter from 9.5 mm to 15.9 mm, such as, for example, 9.5 mm, 11.1 mm, 12.7 mm, 13.5 mm, or 15.9 mm. In certain non-limiting embodiments, the cylindrical outer portion may comprise a length of up to 660 mm. In certain non-limiting embodiments, as shown in FIG. 2, the tuyere may have a circular cross-sectional shape. In certain non-limiting embodiments, the circular cross-section of the inner portion of the tuyere may have a cross-sectional area of from 283.529 $mm^2$ to 794.226 $mm^2$, such as, for example, 283.529 $mm^2$, 387.076 $mm^2$, 506.707 $mm^2$, 572.555 $mm^2$, or 794.226 $mm^2$. In various non-limiting embodiments, the inner portion of the tuyere may comprise an inner diameter of 17/32 inches (13.5 mm). The tuyere may be any suitable size and shape to project a first gas into the molten alloy through a fluid-conducting inner portion and project a second gas into the molten alloy through another fluid conducting second portion such as, for example, an annulus.

In various non-limiting embodiments, the tuyere may be configured to deliver pressurized fluids, such as a gas, to the molten alloy. In certain non-limiting embodiments, the tuyere may deliver gas at a pressure from greater than zero to 500 pounds per square inch, such as, for example, 50 to 300 pounds per square inch or 10 to 250 pounds per square inch. In certain non-limiting embodiments, the tuyere may project the gas into the molten alloy at a pressure effective to reduce the carbon concentration in (i.e., decarburize) the molten alloy. In certain non-limiting embodiments, the tuyere may project the gas into the molten alloy at a pressure effective to agitate the molten alloy. In certain non-limiting embodiments, the tuyere may project the gas into the molten alloy at a pressure effective to stir the molten alloy. In certain non-limiting embodiments, the tuyere may project the gas into the molten alloy at a pressure effective to degas the molten alloy. The tuyere may project the gas into the molten alloy below the surface of the molten alloy. In various non-limiting embodiments, the pressure of the first gas in the inner portion may be the greater than, less than, or equal to the pressure of the second gas in the annulus or other second portion. In various non-limiting embodiments, the pressure of the first gas in the inner portion may be greater than the pressure of the second gas in the annulus or other second portion.

In various non-limiting embodiments, the vessel may comprise at least one of a bottom submerged tuyere and a side submerged tuyere. In various non-limiting embodiments, the vessel may comprise at least one side submerged tuyere. In various non-limiting embodiments, the vessel may comprise a plurality of side submerged tuyeres. In various non-limiting embodiments, the vessel may comprise at least one bottom submerged tuyere. In various non-limiting embodiments, the vessel may comprise an outer shell and a refractory-lined cavity including a mouth to hold the molten alloy. The vessel may be rotatable on trunnions. The tuyere may be surrounded with refractory material up to the tip thereof. In various non-limiting embodiments, the tuyere and gas system may be configured to supply oxygen and an inert gas selected from argon, carbon dioxide, and a combination thereof through a first portion of a tuyere, and one of argon, carbon dioxide, and a combination thereof through a second portion of the tuyere. The first portion may comprise an inner portion concentrically aligned within the second portion comprising an outer portion to define an annulus therebetween. For example, oxygen and carbon dioxide may be injected through the inner portion of the side tuyere into the molten alloy below the surface of the molten alloy, and carbon dioxide may be injected through the annulus of the side tuyere into the molten alloy below the surface of the molten alloy. In various non-limiting embodiments, the vessel may comprise a bottom mixed blowing converter (Q-BOP vessel), a top and bottom mixed blowing converter (K-OBM vessel), or a bottom and side mixed blowing converter (K-OBM-S vessel).

In various embodiments, a method of decarburizing a molten alloy may generally comprise using at least one tuyere comprising a fluid-conducting first portion and a fluid-conducting second portion to inject a first gas comprising at least one of argon, carbon dioxide, and oxygen through the first portion into the molten alloy, and to inject a second gas comprising at least one of argon and carbon dioxide through the second portion into the molten alloy.

In various non-limiting embodiments, a method of decarburizing a molten alloy may generally comprise injecting a first gas through a first fluid-conducting portion of a tuyere into the molten alloy, and injecting a second gas through a second fluid-conducting portion of the tuyere into the molten alloy. The first gas and second gas may independently comprise one or more of air, argon, carbon dioxide, helium, hydrogen, neon, nitrogen, oxygen, and xenon. In various non-limiting embodiments, both the first gas and second gas may lack nitrogen. In various non-limiting embodiments, the first gas may comprise oxygen and an inert gas comprising one of air, argon, carbon dioxide, helium, hydrogen, neon, nitrogen, xenon, and combinations thereof. In various non-limiting embodiments, the inert gas may consist of a mixture of argon and carbon dioxide. In various non-limiting embodiments, the inert gas may consist of carbon dioxide. In various non-limiting embodiments, the inert gas may consist of argon. In various embodiments, the inert gas may lack argon. In various non-limiting embodiments, the second gas may consist of a mixture of argon and carbon dioxide. In various non-limiting embodiments, the second gas may consist of carbon dioxide. In various non-limiting embodiments, the second gas may consist of argon. In various non-limiting embodiments, the second gas may lack argon. In various non-limiting embodiments, the second gas may lack oxygen. In various non-limiting embodiments, a method of decarburizing a molten alloy may generally comprise injecting a first gas comprising oxygen and an inert gas through a first fluid-conducting portion of a tuyere into the molten alloy, and injecting a second gas comprising at least one of carbon dioxide and argon through a second fluid-conducting portion of the tuyere into the molten alloy.

In various non-limiting embodiments, a first portion of a tuyere may comprise an inner cylindrical portion concentrically aligned within a second cylindrical portion to define an annulus therebetween. In various embodiments, the method may comprise cooling the first portion of the tuyere with a gas supplied though the annulus. For example, the gas supplied through the annulus may cool the inner portion of the tuyere to protect the tuyere from the molten alloy. In various non-limiting embodiments, the method may comprise cooling the first portion of the tuyere when carbon dioxide is supplied through the annulus of the tuyere. In various embodiments, the carbon dioxide may effectively cool the tuyere to prolong tuyere service life without preheating the carbon dioxide. In various embodiments, the service life of a tuyere cooled by carbon dioxide supplied through the annulus may be longer than the service life of a tuyere that is not cooled by carbon dioxide.

In various non-limiting embodiments, the first gas and second gas supplied through first and second fluid conducting tuyere portions, respectively, into the molten alloy in the vessel may independently comprise at least one of air, argon, carbon dioxide, helium, hydrogen, neon, nitrogen, oxygen, xenon, and combinations thereof. The first gas may comprise oxygen and an inert gas selected from air, argon, carbon dioxide, helium, hydrogen, neon, nitrogen, xenon, and combinations thereof. In various non-limiting embodiments, the first gas may comprise at least one of argon, carbon dioxide, oxygen, and combinations thereof, and the second gas may comprise one of argon, carbon dioxide, and combinations thereof. In various non-limiting embodiments, the second gas may lack oxygen.

In various non-limiting embodiments, the first gas may consist of argon, carbon dioxide, and oxygen, and the second gas may consist of argon and carbon dioxide. In various non-limiting embodiments, the first gas may consist of oxygen, and the second gas may consist of carbon dioxide. In various non-limiting embodiments, the first gas may consist of oxygen, and the second gas may consist of argon and carbon dioxide. In various non-limiting embodiments, the first gas may consist of argon and oxygen, and the second gas may consist of carbon dioxide. In various non-limiting embodiments, the first gas may consist of argon and oxygen, and the second gas may consist of argon and carbon dioxide. In various non-limiting embodiments, the first gas may consist of carbon dioxide and oxygen, and the second gas may consist of carbon dioxide. In various non-limiting embodiments, the first gas may consist of carbon dioxide and oxygen, and the second gas may consist of argon. In various non-limiting embodiments, the first gas may consist of carbon dioxide and oxygen, and the second gas may consist of argon and carbon dioxide.

In various non-limiting embodiments, a method of decarburizing molten alloys according to the present disclosure may comprise injecting a gas comprising argon through a portion of the tuyere into a molten alloy in a vessel after injecting a gas comprising carbon dioxide and lacking argon through the same portion of the tuyere into a molten alloy in a vessel. In various non-limiting embodiments, the portion of the tuyere may comprise one of an inner cylindrical portion and an annulus defined between the inner cylindrical portion and a concentrically aligned outer cylindrical portion. For example, the method may comprise injecting a gas comprising argon and oxygen through an inner cylindrical portion of a tuyere into the molten alloy after injecting a gas comprising carbon dioxide and oxygen and lacking argon through the inner cylindrical portion of the tuyere into the molten alloy.

In various non-limiting embodiments, the method may comprise injecting the first gas into the molten alloy for up to 1 hour, such as, for example, 5-60 minutes, 10-45 minutes, 15-35 minutes, or 20-30 minutes, and injecting the second gas into the molten alloy for up to 1 hour, such as, for example, 5-60 minutes, 10-45 minutes, 15-35 minutes, or 20-30 minutes. In various embodiments, the first gas and second gas may be injected into the molten alloy for substantially the same period of time or the same period of time. The method may comprise contacting the first gas and/or second gas and the molten alloy for sufficient time to decarburize the molten alloy to the desired carbon concentration. In various embodiments, the method may comprise contacting the first gas and second gas and the molten alloy for up to 1 hour, such as, for example, 5-60 minutes, 10-45 minutes, 15-35 minutes, or 20-30 minutes to decarburize the molten alloy to the desired level. In various embodiments, the first gas and second gas may be injected simultaneously into the molten alloy.

In various non-limiting embodiments, the first gas and second gas may independently have purity of at least 90%, such as, for example, from 90% to 99.999%, at least 95%, at least 98%, or at least 99%. In various non-limiting embodiments, the first gas may have a purity greater than or equal to the purity of the second gas. In various non-limiting embodiments, the first gas may have a purity of at least 90% and the second gas may have a purity of at least 90%. In various non-limiting embodiments, the first gas may have a purity of at least 98% and the second gas may have a purity of at least 95%. In various non-limiting embodiments, the first gas may have a purity of at least 95% and the second gas may have a purity of at least 98%.

In various non-limiting embodiments, the oxygen may have a purity of at least 95%, such as, for example, at least 98% or at least 99.5%. In various non-limiting embodiments, the oxygen may comprise incidental impurities, such as, for example, up to 500 ppm nitrogen, up to 4000 ppm argon, and up to 5 ppm carbon dioxide. In certain non-limiting embodiments, the argon may have a purity of at least 95%, such as, for example, at least 97.5%, at least 98%, or at least 99.998%. In various non-limiting embodiments, the argon may comprise incidental impurities, such as, for example, up to 15 ppm nitrogen, up to 5 ppm oxygen, up to 1 ppm hydrogen, up to 2 ppm carbon dioxide and hydrocarbons, and up to 1 ppm methane. In various non-limiting embodiments, the argon may comprise up to 0.5% nitrogen and up to 2% oxygen. In certain embodiments, the carbon dioxide may have a purity of at least 95%, such as, for example, at least 98% or at least 99.8%.

In various non-limiting embodiments, the method according to the present disclosure may comprise injecting the first gas and the second gas at a pressure independently selected from up to 300 pounds per square inch, a flow rate independently selected from up to 300,000 standard cubic feet per hour ("scfh"), and one of ambient temperature and room temperature. The first gas and/or second gas may not require preheating prior to injecting through the tuyere. In various non-limiting embodiments, the gas comprising carbon dioxide may not require preheating prior to injecting through the tuyere. In various non-limiting embodiments, the first gas comprising carbon dioxide may not require preheating. Without wishing to be bound to any particular theory, it is believed that preheating carbon dioxide prior to injecting into the molten alloy may increase the amount of carbon dioxide needed to decarburize the molten alloy.

The first gas may have a pressure from 25 to 300 pounds per square inch, such as, for example, 50 to 300 pounds per square inch, 75 to 250 pounds per square inch, or 100 to 200 pounds per square inch. The first gas may have a flow rate from 100,000 scfh to 300,000 scfh, such as, for example, 140,000 scfh to 260,000 scfh, or 180,000 scfh to 220,000 scfh. The first gas may have a temperature from 18° C. to 24° C., such as, for example, 20° C.

The second gas may have a pressure from 25 to 300 pounds per square inch, such as, for example, 50 to 200 pounds per square inch, or 75 to 125 pounds per square inch. The second gas may have a flow rate from 10,000 scfh to 30,000 scfh, such as, for example, 15,000 scfh to 27,000 scfh, or 20,000 scfh to 25,000 scfh. In various non-limiting embodiments, the flow rate ratio of the first gas to the second gas may be from 30:1 to 3.33:1, such as, 20:1 to 5:1, or 10:1 to 6:1. In various non-limiting embodiments, the second gas may have a temperature from 18° C. to 24° C., such as, for example 20° C.

In various embodiments, the combined gases, i.e., the sum of the first gas(es) and second gas(es), may have a ratio of oxygen to carbon dioxide from up to 20:1, such as, for example, 1:1 to 20:1, 3.5:1 to 20:1, 4:1 to 20:1, 5:1 to 20:1, 10:1 to 20:1, up to 10:1, 1:1 to 10:1, 3.5:1 to 10:1, 4:1 to 10:1, 5:1 to 10:1, 6:1 to 9:1, greater than 3.5:1, greater than 4:1, greater than 3.5:1 up to 10:1, greater than 4:1 up to 10:1, greater than 5:1 up to 10:1, greater than 3.5:1 up to 7:1, greater than 4:1 up to 7:1, or greater than 5:1 up to 7:1. In various non-limiting embodiments, the gases may have a ratio of oxygen to argon greater than 3.5:1 up to 10:1, such as, for example, greater than 3.5:1 up to 7:1, or greater than 3.5:1 up to 5:1. In various non-limiting embodiments, the ratio of oxygen to carbon dioxide may be effective to cool the tuyere. Without wishing to be bound to any particular theory, it is believed that below a minimum ratio of oxygen to carbon dioxide, the tuyere may cool sufficiently to form knurdles that adversely impede gas flow. In various non-limiting embodiments, the ratio of oxygen to carbon dioxide may be effective to maintain substantial tuyere life without preheating the carbon dioxide. In various non-limiting embodiments, the carbon dioxide may only protect the tuyere from the molten alloy and may not dilute carbon monoxide for preferentially removing carbon instead of chromium and/or manganese from the molten alloy. In various non-limiting embodiments, the combined gases may have a ratio of oxygen to inert gasses, e.g., carbon dioxide and argon, that is the same as the ratio of oxygen to carbon dioxide described above.

In various non-limiting embodiments, a method of treating a molten alloy with carbon dioxide may generally comprise injecting a first gas comprising argon, carbon dioxide, oxygen, or combinations thereof through a first fluid-conducting portion of a tuyere into the molten alloy below the surface of the molten alloy, and injecting one of argon, carbon dioxide, and a combination thereof through a second fluid-conducting portion of the tuyere into the molten alloy below the surface of the molten alloy. The first fluid-conducting portion comprises an inner cylindrical portion concentrically aligned within an outer cylindrical portion to define the second fluid-conducting portion in the form of an annulus therebetween. The first gas and second gas may be independently selected from air, argon, carbon dioxide, helium, hydrogen, neon, nitrogen, oxygen, xenon, and combinations thereof. In a non-limiting embodiment, the first gas may comprise oxygen and the second gas may comprise an inert gas selected from argon, carbon dioxide, and combinations thereof. In a non-limiting embodiment, the first gas may comprise oxygen and the second gas may comprise carbon dioxide. In a non-limiting embodiment, the first gas may comprise oxygen, argon, and carbon dioxide, and the second gas may comprise carbon dioxide.

In various non-limiting embodiments, a method of decarburizing molten alloy may generally comprise injecting a first gas through a first fluid-conducting portion of a tuyere into the molten alloy below the surface of the molten alloy, and injecting a second gas through a second fluid-conducting portion of the tuyere into the molten alloy below the surface of the molten alloy. In various non-limiting embodiments, the first gas may comprise carbon dioxide and oxygen, and the second gas may comprise carbon dioxide. In various non-limiting embodiments, the first gas and second gas may be independently selected from air, argon, carbon dioxide, helium, hydrogen, neon, nitrogen, oxygen, xenon, and combinations thereof. In various non-limiting embodiments, the first gas may comprise oxygen and the second gas may comprise carbon dioxide. In various non-limiting embodiments, the first gas may comprise oxygen and argon, and the second gas may comprise carbon dioxide. In various non-limiting embodiments, the first gas may comprise oxygen, argon, and carbon dioxide, and the second gas may comprise carbon dioxide.

In various non-limiting embodiments, without wishing to be bound to any particular theory, it is believed that the use of carbon dioxide and/or argon as an inert gas may reduce the carbon content of the molten alloy to levels of up to 0.25 weight percent, based on total molten alloy weight, such as, for example, up to 0.2 weight percent, up to 0.1 weight percent, up to 0.05 weight percent, up to 0.025 weight percent, up to 0.01 weight percent, up to 0.005 weight percent, less than 0.25 weight percent, less than 0.20 weight percent, less than 0.10 weight percent, less than 0.05 weight percent, less than 0.025 weight percent, less than 0.01 weight percent, or less than 0.005 weight percent. In various non-limiting embodiments, without wishing to be bound to any particular theory, it is believed that the use of carbon dioxide may reduce the carbon content of the molten alloy to levels of up to 0.25 weight percent, such as, for example, 0.1 weight percent to 0.25 weight percent, 0.05 to 0.1 weight percent, 0.025 to 0.05 weight percent, or 0.01 to 0.025 weight percent. In various non-limiting embodiments, without wishing to be bound to any particular theory, it is believed that the use of argon may reduce the carbon content of the molten alloy to levels of up to 0.1 weight percent, such as, for example, up to 0.05 weight percent, up to 0.025 weight percent, up to 0.015 weight percent, up to 0.010 weight percent, or up to 0.005 weight percent.

In various non-limiting embodiments, without wishing to be bound to any particular theory, it is believed that the use of carbon dioxide may reduce the final carbon content of the molten alloy to levels of up to 0.1 weight percent, such as, for example, 0.025 to 0.1 weight percent, or 0.05 to 0.1 weight percent, and the use of argon and, optionally, carbon dioxide may reduce the final carbon content of the steel to levels of less than 0.05 weight percent, such as, for example, less than 0.025 weight percent, less than 0.010 weight percent, or less than 0.005 weight percent.

Figure 3:
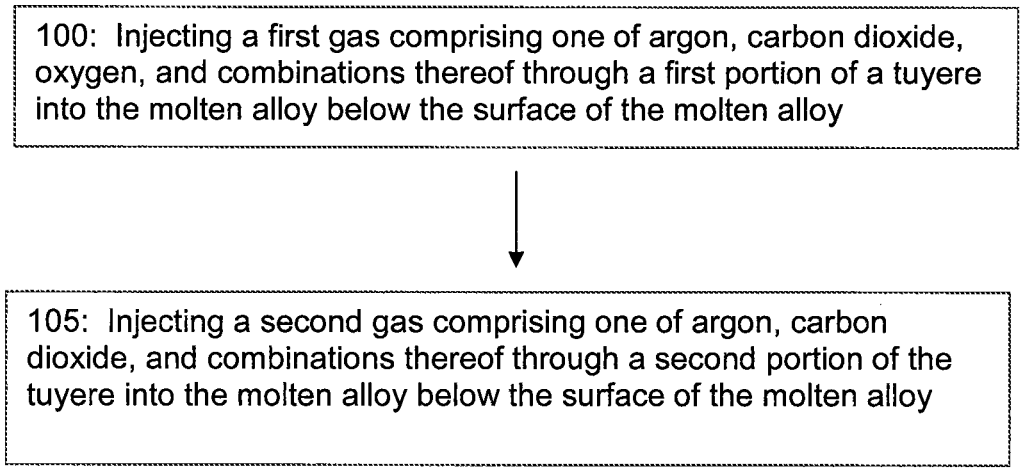
FIG. 3 is a flowchart illustrating a non-limiting embodiment of a method of decarburizing a molten alloy according to the present disclosure.

Referring to FIG. 3, in various non-limiting embodiments, a method of decarburizing a molten alloy according to the present disclosure may generally comprise injecting 100 a first gas comprising argon, carbon dioxide, oxygen, or combinations thereof through a first fluid-conducting portion of a tuyere into the molten alloy below the surface of the molten alloy; and injecting 105 argon, carbon dioxide, or a combination thereof through a second fluid-conducting portion of the tuyere into the molten alloy below the surface of the molten alloy. The first fluid-conducting portion may comprise a cylindrical inner portion concentrically aligned within a cylindrical outer portion to define an annulus therebetween which operates as the second fluid-conducting portion. The method may comprise injecting the first gas through the inner portion and injecting the second gas through the annulus. In various non-limiting embodiments, the tuyere may comprise a carbon dioxide cooled tuyere. The carbon dioxide may cool the inner portion of the tuyere and/or outer portion of the tuyere.

In various non-limiting embodiments, the alloy processed according the present invention may be selected from stainless steel, carbon steel, low carbon steel, iron base alloys, nickel base alloys, and cobalt base alloys. In various embodiments, the alloy may comprise, in weight percentages based on total alloy weight, 90 to 99 iron, and impurities. In various embodiments, the alloy may comprise, in weight percentages based on total alloy weight, 97 to 99 iron, and impurities.

In various non-limiting embodiments, the alloy may have a composition suitable for providing a grain oriented electrical steel (GOES). Grain oriented electrical steel may be used as core material in transformers, motors, generators, and other electronic devices. Grain oriented electrical steel may include low levels of oxidizable elements, such as, for example, carbon, phosphorous, chromium, and/or manganese, as well as low levels of nitrogen. In various embodiments, grain oriented electrical steel may comprise, in weight percentages based on total alloy weight, 93 to 99 iron, 0.6 to 3.7 silicon, up to 1.0 nickel, up to 0.5 manganese, up to 0.5 aluminum, up to 0.5 copper, up to 0.4 chromium, up to 0.1 titanium, and residual impurities. Residual impurities may comprise, for example, one or more of sulfur, phosphorous, nitrogen, arsenic, boron, cadmium, calcium, cobalt, lead, molybdenum, columbium, tin, vanadium, and zirconium. In various non-limiting embodiments, the method may comprise providing an alloy composition that conforms to the requirements in ASTM Standard A876, 2012, "Standard Specification for Flat-Rolled, Grain-Oriented, Silicon-Iron, Electrical Steel, Fully Processed Types", ASTM International, West Conshohocken, Pa., 2012, DOI: 10.1520/A0876-12, www.astm.org.

In various non-limiting embodiments, a method of refining a grain oriented electrical steel may generally comprise providing within a cavity of a vessel a molten alloy selected from stainless steel, carbon steel, low carbon steel, iron base alloys, nickel base alloys, and cobalt base alloys. The vessel may comprise a side tuyere extending into the cavity, below the surface of the molten alloy. The side tuyere may comprise an outer portion and an inner portion concentrically aligned within the outer portion to define an annulus therebetween. A first gas comprising at least one of argon, carbon dioxide, and oxygen may be injected through the inner portion of the side tuyere into the molten alloy below the surface of the molten alloy. A second gas comprising one of argon, carbon dioxide, and a combination thereof may be injected through the annulus of the tuyere into the molten alloy below the surface of the molten alloy. The alloy may be treated by this method to reduce a carbon content of the alloy from an initial carbon content to a final carbon content no greater than 0.010 weight percent, based on total alloy weight. In various non-limiting embodiments, the molten alloy may be an iron base alloy comprising, in weight percentages based on total alloy weight, 90 to 99 iron, up to 3.7 silicon, up to 1.0 nickel, up to 0.5 manganese, up to 0.5 aluminum, up to 0.5 copper, up to 0.4 chromium, up to 0.1 titanium, and incidental impurities.

In various non-limiting embodiments, the method may further comprise using the refined alloy to manufacture a grain oriented electrical steel. The method may further comprise adding to a melt of the refined alloy at least one of silicon, nickel, manganese, aluminum, copper, chromium, and titanium, to provide a grain oriented electrical steel comprising, in weight percentages based on total alloy weight: 93 to 99 iron, 0.6 to 3.7 silicon, up to 1.0 nickel, up to 0.5 manganese, up to 0.5 aluminum, up to 0.5 copper, up to 0.4 chromium, up to 0.1 titanium, and incidental impurities.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art.

While particular embodiments have been illustrated and described herein, it those skilled in the art will understand that various other changes and modifications can be made without departing from the spirit and scope of the invention. Those skilled in the art will recognize, or be able to ascertain using no more than routine experimentation, numerous equivalents to the specific methods described herein, including alternatives, variants, additions, deletions, modifications and substitutions. This disclosure, including the appended claims, is intended to cover all such equivalents that are within the spirit and scope of this invention.

We claim:

1. A method of decarburizing a molten alloy, the method comprising:

injecting a first gas comprising oxygen through a first fluid-conducting portion of a tuyere into a molten alloy below a surface of the molten alloy; and injecting a second gas comprising carbon dioxide through a second fluid-conducting portion of the tuyere into the molten alloy below the surface of the molten alloy, wherein a volume ratio of oxygen to carbon dioxide injected through the tuyere is at least 6:1;

whereby a carbon content of the molten alloy is reduced.

2. The method of claim 1, wherein a carbon content of the molten alloy is reduced to no greater than 0.25 weight percent, based on total alloy weight.

3. The method of claim 1, wherein a carbon content of the molten alloy is reduced to no greater than 0.010 weight percent, based on total alloy weight.

4. The method of claim 1, wherein a carbon content of the molten alloy is reduced to no greater than 0.025 weight percent, based on total alloy weight.

5. The method of claim 1, wherein the tuyere comprises a carbon dioxide cooled tuyere.

6. The method of claim 1, wherein:

the first fluid-conducting portion of the tuyere comprises an inner cylindrical portion; and the second fluid-conducting portion comprises an annulus defined between the inner cylindrical portion and a concentrically aligned outer cylindrical portion.

7. The method of claim 6, further comprising injecting the first gas through the inner cylindrical portion and injecting the second gas through the annulus.

8. The method of claim 1, wherein the volume ratio of oxygen to carbon dioxide is at least 6:1 up to 20:1.

9. The method of claim 1, wherein each of the first gas and second gas lack argon.

10. The method of claim 9, wherein the first gas further comprises carbon dioxide at room temperature.

11. The method of claim 9, wherein the carbon dioxide is not heated prior to injecting the carbon dioxide.

12. The method of claim 1, wherein the first gas consists essentially of oxygen and the second gas consists essentially of carbon dioxide.

13. The method of claim 1, wherein the first gas consists of oxygen and the second gas consists of carbon dioxide.

14. The method of claim 1, wherein the first gas further comprises an inert gas comprising argon, and wherein a volume ratio of oxygen to inert gas and carbon dioxide is greater than 3.5:1.

15. The method of claim 1, further comprising:

providing the molten alloy within a vessel having an outer shell, a cavity, a refractory material lining within the cavity, and at least one tuyere passing through the outer shell and the refractory material lining and into the cavity; and injecting the first gas and second gas through a side of the vessel.

16. The method of claim 1, further comprising cooling the first fluid-conducting portion of the tuyere when the second gas is injected through the second fluid-conducting portion of the tuyere.

17. The method of claim 1, wherein the molten alloy is selected from the group consisting of carbon steel, low carbon steel, iron base alloys, nickel base alloys, and cobalt base alloys.

18. A method of decarburizing an alloy, the method comprising:

providing a molten iron base alloy within a vessel, wherein the vessel comprises a side tuyere below a surface of the molten alloy, the side tuyere comprising an outer portion and an inner portion concentrically aligned within the outer portion to define an annulus therebetween, injecting a first gas comprising oxygen through the inner portion of the tuyere into the molten alloy below a surface of the molten alloy, and injecting a second gas comprising carbon dioxide through the annulus of the tuyere into the molten alloy below the surface of the molten alloy, wherein a volume ratio of oxygen to carbon dioxide is at least 6:1;

whereby a carbon content of the molten alloy is reduced to no greater than 0.25 weight percent, based on total alloy weight.

19. The method of claim 18, wherein a carbon content of the molten alloy is reduced to no greater than 0.010 weight percent, based on total alloy weight.

20. The method of claim 18, wherein a carbon content of the molten alloy is reduced to no greater than 0.025 weight percent, based on total alloy weight.

21. The method of claim 18, wherein the tuyere comprises a carbon dioxide cooled tuyere.

22. The method of claim 18, wherein each of the first gas and second gas lack argon.

23. The method of claim 22, wherein the first gas further comprises carbon dioxide at room temperature.

24. The method of claim 22, wherein the carbon dioxide is not heated prior to injecting the carbon dioxide.

25. The method of claim 18, wherein the first gas consists essentially of oxygen and the second gas consists essentially of carbon dioxide.

26. The method of claim 18, wherein the first gas consists of oxygen and the second gas consists of carbon dioxide.

27. The method of claim 18, wherein the first gas further comprises an inert gas comprising argon, and wherein a volume ratio of oxygen to inert gas and carbon dioxide is greater than 3.5:1.

28. The method of claim 18, further comprising cooling the inner portion of the tuyere when the second gas is injected through the annulus of the tuyere.

* * * * *